US005476193A

United States Patent [19]

Haynes

[11] Patent Number: 5,476,193

[45] Date of Patent: Dec. 19, 1995

[54] POSITIVE DISPLACEMENT, VOLUMETRIC RATIO BEVERAGE DISPERSING APPARATUS

[76] Inventor: Joel E. Haynes, 18316 Oxnard St., Tarzana, Calif. 91356

[21] Appl. No.: 272,552

[22] Filed: Jul. 11, 1994

[51] Int. Cl.[6] ..... B67D 5/56

[52] U.S. Cl. ..... 222/129.2; 91/314; 222/136; 222/249; 222/334; 417/404

[58] Field of Search ..... 222/129.2, 136, 222/249, 250, 334; 91/305, 314, 337, 338, 341 R; 417/376, 404

[56] References Cited

U.S. PATENT DOCUMENTS

| | | | |
|---|---|---|---|
| 1,281,490 | 10/1918 | Billado | 91/338 |
| 2,736,466 | 2/1956 | Rodth | 222/129.2 X |
| 3,601,987 | 8/1971 | Chermensky et al. | 222/334 |
| 4,325,285 | 4/1982 | Roser | 91/341 R |
| 4,779,761 | 10/1988 | Rudick et al. | 222/129.2 X |
| 4,953,754 | 9/1990 | Credle, Jr. | 222/129.2 |
| 4,967,936 | 11/1990 | Bingler | 222/129.2 |

FOREIGN PATENT DOCUMENTS

| | | | |
|---|---|---|---|
| 0315264 | 5/1989 | European Pat. Off. | 222/250 |

*Primary Examiner*—Andres Kashnikow
*Assistant Examiner*—Joseph A. Kaufman
*Attorney, Agent, or Firm*—Jack C. Munro

[57] ABSTRACT

A beverage dispensing apparatus for dispensing through a nozzle a preestablished volume of a syrup and a preestablished volume of a soda to be intermixed within a nozzle prior to being dispensed into a collecting container such as a glass. The syrup side is connected to the soda side with the dispensing operation always occurring simultaneously in the preestablished ratios. The soda side includes a drive piston which is driven by the pressurized soda. The soda drive piston is physically connected to a syrup drive piston which controls the flow of the syrup to the dispensing nozzle. A single dispensing valve such as a low-power solenoid is to be used to cause the dispensing of both the soda and the syrup.

8 Claims, 3 Drawing Sheets

POSITIVE DISPLACEMENT, VOLUMETRIC RATIO BEVERAGE DISPERSING APPARATUS

BACKGROUND OF THE INVENTION

1) Field of the Invention

The present invention relates primarily to dispensing apparatuses and especially those that are used in post-mix beverage dispensers and to valves that can control and mix a specific established ratio of syrup and soda.

2) Description of the Prior Art

Post-mix beverage dispensers control the flow and mixing of two or more liquids. Generally, one liquid is non-viscous such as water which is saturated with carbon dioxide ($CO_2$) and the other liquid is a concentrate, such as a flavored syrup. The dispenser delivers the liquids into a container with the liquids mixing to comprise the beverage that is to be contained. Ideally, the dispensing of the liquids is to be accomplished rapidly and at the proper mixture ratio.

The primary use of such post-mix beverage dispensers has been in the fast food environment. The clerk that is dispensing the beverage places a cup or glass in association with the beverage dispenser at which time the beverage dispenser is activated thereby dispensing the separate liquids into a cup or glass producing the resulting beverage. It is important for the clerk to achieve the dispensed beverage as quickly as possible, thereby permitting the clerk to serve as many people in the shortest amount of time. It is important that each time the clerk activates the dispenser that a consistent correct ratio of the soda to the syrup is dispensed. In the past, fast acting valves, usually electrical solenoids, control the flow of the syrup and the soda through separate conduits which are designed to open simultaneously into a dispensing nozzle and hence from the dispensing nozzle into the cup or glass. In the past flow regulators for both the soda and the syrup has been utilized to maintain a fixed ratio between the syrup and the soda. However, in the past these flow regulators quickly begin to vary from the preestablished ratio, resulting in an incorrect ratio between the soda and the syrup being dispensed. As a result the post-mix dispensers of the prior art require frequent recalibration to have these dispensers dispense the correct preestablished volume of soda to the preestablished volume of syrup.

In the past volumetric ratio valves have also been utilized. However, these volumetric ratio valves require valving solenoids, electronic sensors, and microswitches in order to achieve the necessary switching for the solenoids. Such volumetric ratio valves in the past have proven to be quite costly, as well as placing heavy duty requirements on the solenoids as such must energize and deenergize the mainstream soda flow and syrup flow. All parts of such volumetric ratio valves of the prior art are designed to be at the syrup input pressure at all times which places added requirements and costs upon these volumetric ratio valves.

SUMMARY OF THE INVENTION

The primary objective of the present invention is to construct a simple, inexpensive, positive displacement, ratio controlled, beverage dispensing apparatus that requires no electrical switching solenoids, with the exception of a single low power solenoid that functions to activate the dispensing cycle.

The dispensing apparatus of the present invention utilizes a soda dispensing section (or side) and a syrup dispensing section (or side). The soda side includes a drive piston with the syrup side including a separate drive piston. The drive piston of the soda side and the syrup side are connected together so as to operate simultaneously in a forward direction and a reverse direction. A single solenoid which functions as an on/off switch is to be activatable when dispensing is desired. Activation of that solenoid will cause both drive pistons to move in either the forward direction or the reverse direction with dispensing of the syrup and the soda to occur in the precise, preestablished ratio during movement of the pistons in the forward direction or during movement of the pistons in the reverse direction. The syrup side is unaffected by supply pressure of the syrup since the volume of syrup that is to be dispensed within a single cycle is located at ambient air pressure. The pressure of the soda is used to operate both drive pistons.

Another objective of the present invention is to construct a post-mix beverage dispenser which provides a positive displacement ratio control with a high degree of accuracy which operates solely from the incoming pressure of the soda and requires no solenoid switching to control the flow of the soda and the syrup.

Another objective of the present invention is to construct a post-mix beverage dispenser which dispenses a high quality beverage at any desired flow rate from one and one-half to six ounces per second.

Another objective of the post-mix beverage dispenser of this invention is to construct an apparatus which will operate with almost any beverage dispensing system currently being used such as bag in a box, pressurized containers or gravity dispensing containers.

Another objective of the present invention is to construct a beverage dispenser that requires only a single low power electrical solenoid for actuation which exhibits low pressure loss and will operate at high or low flow rates for both the soda and the syrup and also over a wide range of pressure inputs for both the soda and the syrup.

Another objective of the present invention is to provide a beverage dispensing apparatus that allows syrup to enter only in quantities as demanded by the flow of the soda, requiring no separate adjustment or calibration.

Another objective of the present invention is to construct a beverage dispensing apparatus that can be interfaced with most post-mix dispensing systems and includes independent manually operated shutoff valves for the soda and the syrup so as to provide for quick disconnection of the dispensing apparatus from the post-mix dispensing system in order to facilitate cleaning.

Another objective of the present invention is to construct a post-mix beverage dispensing apparatus that provides for a fixed soda-to-syrup ratio that requires no field adjustment of the ratio after installation.

DETAILED DESCRIPTION OF THE SHOWN EMBODIMENT

Figure 1:
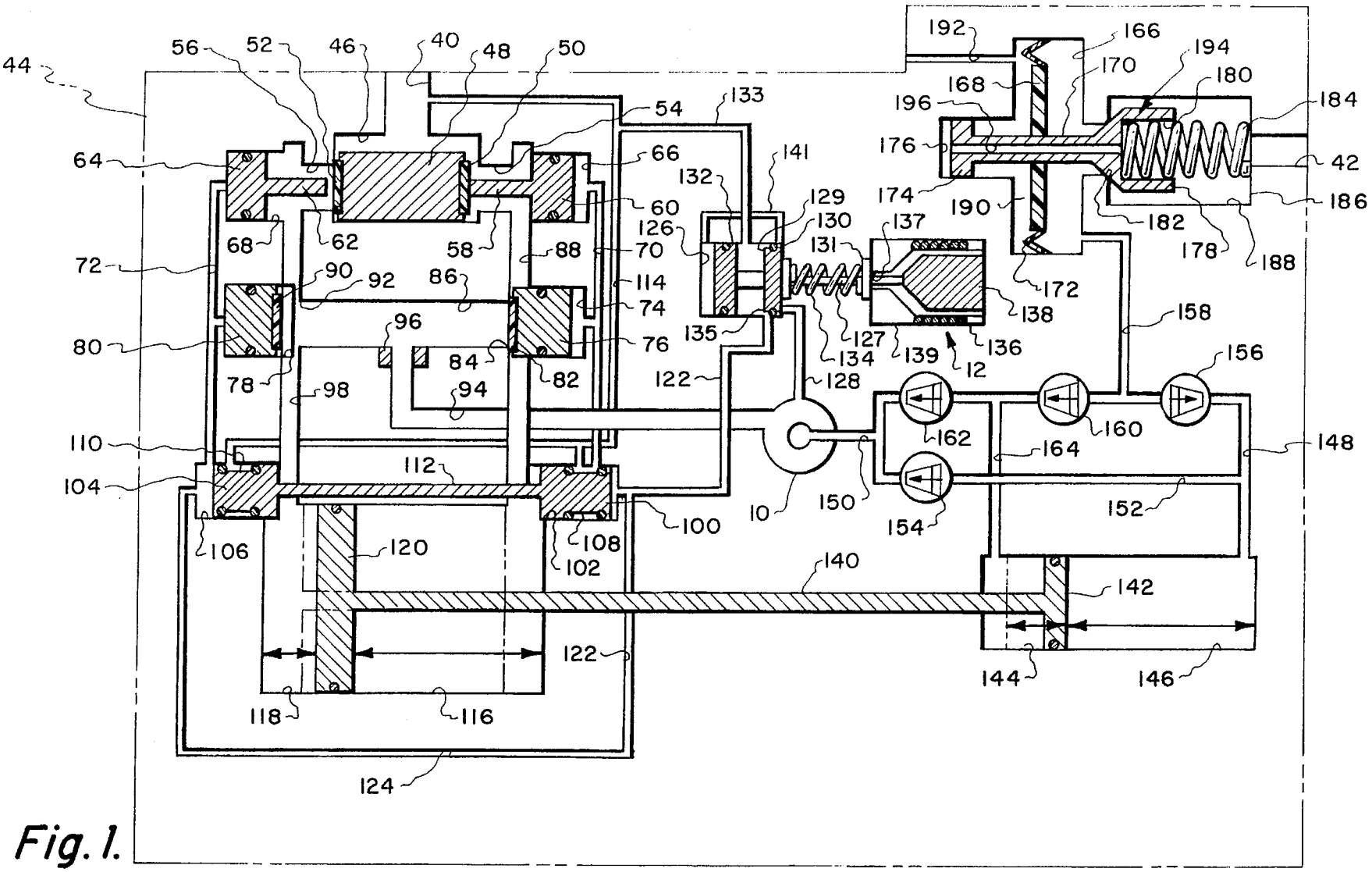
FIG. 1 is a diagrammatic view of the dispensing apparatus of the present invention showing the dispensing apparatus in one position.

The present invention is designed to be utilized in conjunction with a nozzle to affect dispensing of the beverage. One such nozzle is shown and described within U.S. Pat. No. 5,186,363 issues Feb. 16, 1993, entitled LIQUID MIXING AND DISPENSING NOZZLE, by the present inventor. If one wishes a further detailed description of the type of nozzle that is intended to be utilized in conjunction with the beverage dispensing apparatus of the present invention, reference is to be had to the foregoing patent.

The dispensing nozzle 10 is shown in the drawings. Below the dispensing nozzle 10 there is to be located the container (not shown) from which the beverage, mixed by the beverage dispensing apparatus of this invention, is to be dispensed. Activation of the beverage dispensing apparatus of this invention is to occur by operation of the solenoid 12. Operation of the solenoid 12 can be by a manually operated push button, a lever which would be contactable by the beverage container which is to contain the beverage, or by any other convenient means of activation.

Figure 4:
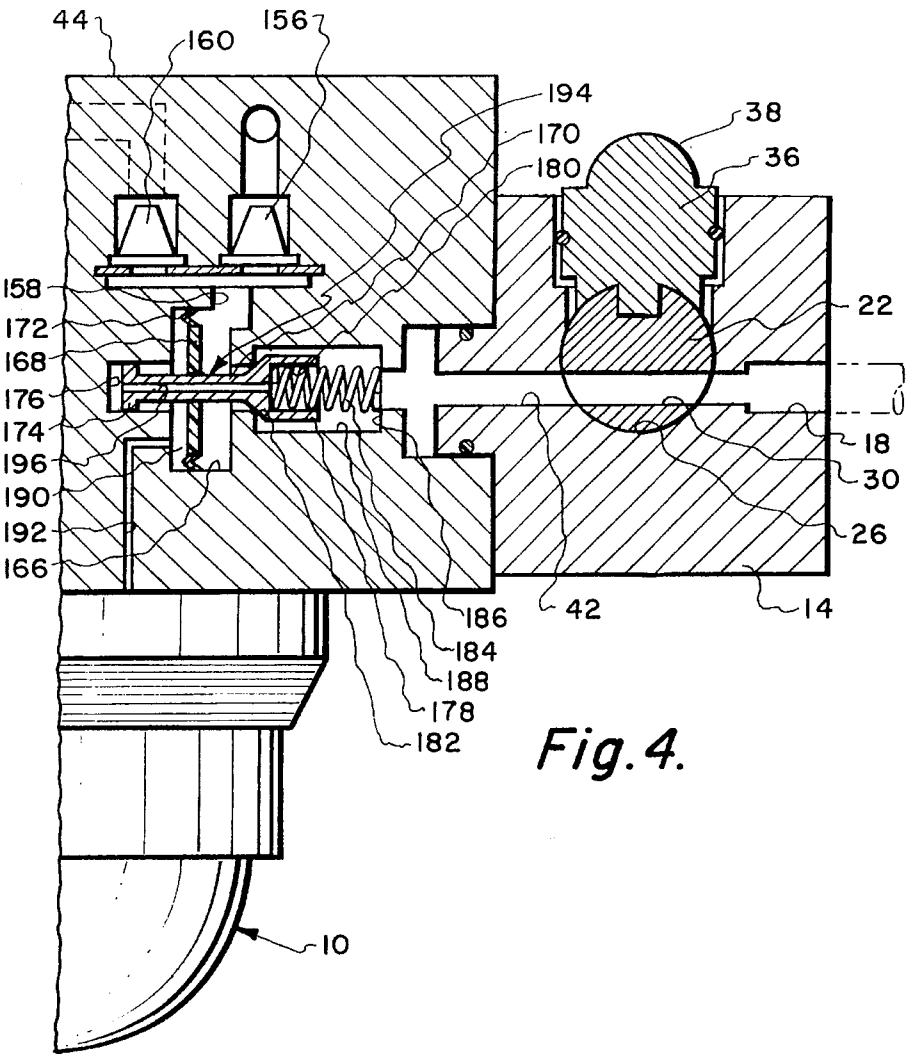
FIG. 4 is a cut-away, side elevational view, partly in cross section of the soda side of the beverage dispensing apparatus of the present invention.
Figure 3:
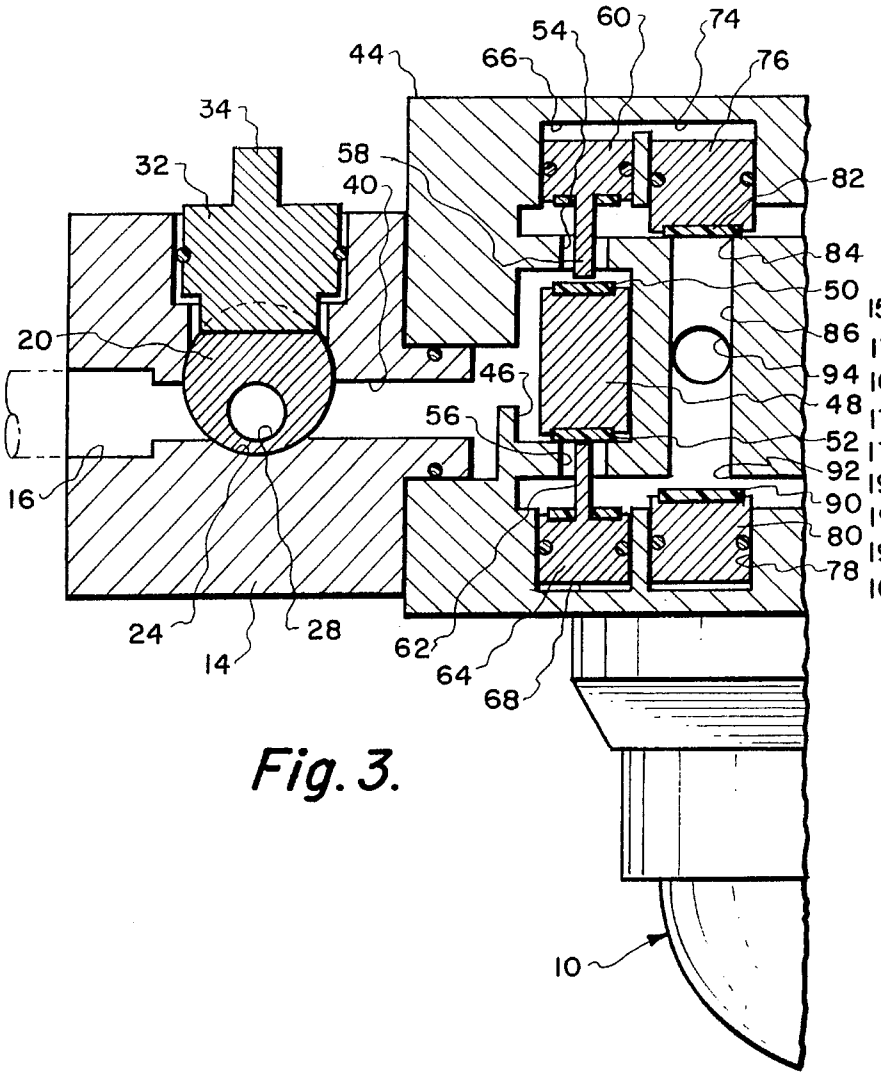
FIG. 3 is a cut-away, side elevational view, partly in cross section of the soda side of the beverage dispensing apparatus of the present invention.

Referring particularly to FIGS. 3 and 4, there is depicted the left side of the nozzle 10 in FIG. 3 and the right side of the nozzle 10 in FIG. 4. It is to be understood that both FIGS. 3 and 4 only show a part of the overall beverage dispensing apparatus of this invention. There is included a mounting block 14 and within the mounting block 14 is formed through passageway 16 and through passageway 18. It is to be noted that through passageway 18 is a substantially smaller diameter than through passageway 14 with it being intended that the through passageway 18 is to have pass therethrough the syrup with the soda being conducted through passageway 16. It is to be understood that within the scope of this invention that the syrup in through passageway 18 will constitute some type of a flavored semi-viscous liquid which is in a concentrated form. The soda 16 will normally comprise a carbonated type of thin watery liquid, water itself or any other type of basic solution. The mounting block 14 will normally be constructed of a plastic.

Mounted within the passageway 16 is a ball 20. Also mounted within the passageway 18 is a ball 22. The ball 20 sets within a seat 24 formed within the passageway 16. In a similar manner the ball 22 sets within a seat 26 formed within the passageway 18. The ball 20 includes a through hole 28 with ball 22 including a through hole 30. Fixedly connected to the ball 20 is a pivotable block 32 which includes a handle 34. In a similar manner, fixedly secured to the ball 22 is a pivotable block 36 which includes a handle 38. The block 32 and the ball 20, as well as the block 36 and the ball 22, both function as shutoff valves for their respective passageways 16 and 18. Manual operation of handle 34 can either locate the through hole 28 aligned with the passageway 16 or located transverse to the passageway 16. When through hole 28 is aligned with the passageway 16, soda is capable of passing through the passageway 16 into input passageway 40. In a similar manner the handle 38 can be manually operated to pivot the ball 22 so that the through hole 30 can be aligned with the passageway 18 as is shown in FIG. 4 or can be located transverse to the passageway 18, thereby blocking the flow of syrup through passageway 18. When the through hole 30 is located aligned with the passageway 18, the syrup is to flow into syrup input channel 42. However, when the handles 34 and 38 are manually moved so that the through holes 28 and 30 are located transverse to their respective passageways 16 and 18, with this transverse position being shown in FIG. 3 of the drawings, there is no flow into the input channels 40 and 42. This will permit the valve body 44 to be disengaged along with the nozzle 10 from the mounting block 14 and partially disassembled for cleaning purposes.

Referring particularly now to FIG. 1, when soda under pressure is first applied to the inlet channel 40, it fills channel 46. Within channel 46 is located a three-way valve in the form of valve piston 48. One end of the valve piston 48 includes an elastomeric disc 50 with the opposite end of the valve piston 48 including an elastomeric disc 52. Valve piston 48 is capable of limited longitudinal sliding movement with the elastomeric disc 50 being located to either close port 54 or have port 54 be open. In a similar manner the elastomeric disc 52 is capable of closing port 56. If elastomeric disc 50 closes port 54, then elastomeric 52 is located so that port 56 is open. In the case of the reverse, port 54 would be open. A rubber or rubber-coated ball could replace piston 48 and the elastomeric discs 50 and 52 would not be necessary. A stem 58 of a valve piston 60 is to physically be able to contact the elastomeric disc 50. In a similar manner a stem 62 of a valve piston 64 is to be able to physically contact the elastomeric disc 52. The valve piston 60 is slidably mounted within chamber 66. In a similar manner the valve piston 64 is slidably mounted within the chamber 68. Connecting with the chamber 66 is a passageway 70. Connecting with the chamber 68 is a passageway 72.

Passageway 70 connects with a separate chamber 74 within which is slidably mounted a valve piston 76. In a similar manner passageway 72 connects with chamber 78 within which is slidably mounted a valve piston 80. Valve piston 76 includes an elastomeric disc 82 which is capable of closing off port 84 of channel 86. The valve piston 76 is capable of being moved a slightly spaced distance from the port 84 so as to permit connection of channel 86 with channel 88. In a similar manner the valve piston 80 includes an elastomeric disc 90 which is to function to be able to close off port 92 of channel 86. The port 92 connects with a channel 98. Channel 98 connects with chamber 68 and channel 88 connects with chamber 66.

Channel 86 connects with an outlet channel 94 which connects with the nozzle 10. Within the outlet channel 94 is located a flow washer 96. The flow washer 96 is to have a preestablished internal diameter which will determine the precise amount of flow that is capable of flowing to the nozzle 10. Flow washers of varying sizes could be utilized to regulate the flow of the soda to the nozzle 10 through the channel 94 from between one and one-half ounces per second to six ounces per second. Obviously the washer 96 would have a much greater diameter at six ounces per second than at one and one-half ounces per second.

A slide piston 100 is movably mounted within a chamber 102. In a similar manner, a slide piston 104 is movably mounted within a chamber 106. Slide piston 100 includes an annular groove 108. Slide piston 104 includes an annular groove 110. A connecting stem 112 is fixedly secured and extends between the slide pistons 100 and 104. When slide piston 100 moves to the right within its chamber 102, then slide piston 104 will also move to the right within its chamber 106. The opposite is true of slide valve pistons 100 and 104 if such move to the left within their respective chambers 102 and 106.

A passageway 114 connects between the soda inlet channel 40 and chambers 102 and 106. Also connecting with chamber 102 is passageway 70. Passageway 72 connects with chamber 106.

The annular groove 108 is capable of being positioned within the chamber 102 so that soda is capable of flowing through passageway 114, through annular groove 108 into passageway 70. In a similar manner the annular groove 110 is capable of being positioned so that soda can flow from passageway 114 through annular groove 110 and into passageway 72. However, if soda is capable of flowing from passageway 114 into passageway 70, flow from passageway 114 into passageway 72 is prevented. If flow is permitted from passageway 114 into passageway 72, then no flow is capable of occurring from passageway 114 into passageway 70.

The chamber 102 connects with the inner end 116 of a soda drive piston chamber. In other words the slide piston 100 is capable of being partially located within the inner end 116 of the soda drive piston chamber. In a similar manner the chamber 106 connects with the outer end 118 of the soda drive piston chamber. This causes the slide piston 104 to be partially locatable within the outer end 118 of the soda drive piston chamber. Contained within the soda drive piston chamber is a soda drive piston 120. Passageway 88 connects with the inner end 116 and passageway 98 connects with the outer end 118. The soda drive piston 120 maintains a separation between the inner end 116 and the outer end 118.

Passageway 124 connects the outer end of chamber 102 to the outer end of chamber 106. A control piston 132 is movably mounted within a chamber 126. Control piston 132 includes an annular groove 129 and is connected to magnetizable block 138 of solenoid 12 by connecting rod 127. Connecting rod 127 passes through opening 137 of solenoid housing 139. An electric coil 136 is mounted around magnetizable block 138. Passageway 133 connects inlet soda passageway 114 to chamber 126. Passageway 122 connects chamber 126 to passageway 124. The exhaust passageway 128 connects chamber 126 to nozzle 10. Retainer disk 131 is fixedly mounted on rod 127. Spring 134 is mounted between wall 130 of chamber 126 and retainer disk 131. Retainer disk 131 abuts solenoid housing 139 in the position of FIG. 1.

In the normally closed position, the annular groove 129 is positioned within chamber 126 so that soda is capable of flowing through passageway 133, through annular groove 129 into passageway 122, through passageway 124 into both the outer end of chamber 102 and the outer end of chamber 106. In this position, the exhaust passageway 128 is closed by means of an annular elastomeric seal 135 which is mounted on control piston 132. The annular elastomeric seal 135 is biased continuously to the closed position by coil spring 134 as is shown in FIG. 1. When coil 136 is deactivated, annular elastomeric seal 135 is moved by spring 134 to the position shown in FIG. 1 against the wall of chamber 126 closing passage 128. In order for this movement to occur, a pressure relief passage 141 is provided to balance the fluid pressure in chamber 126 on each side of control piston 132.

The soda drive piston 120 has mounted thereon an elongated stem 140. The opposite of the stem 140 connects to a syrup drive piston 142. The syrup drive piston 142 is slidably mounted within a syrup drive piston chamber which is composed of an inner end 144 and an outer end 146. The outer end 146 is connected to check valve 154 by passageway 148, and check valve 154 is connected to nozzle 10 by passageway 150. The check valve 154 permits a flow of syrup in the direction from outer end 146 to outlet passageway 150. The inner end 144 is connected to check valve 162 by passageway 164, and check valve 162 is connected to nozzle 10 by passageway 150. The check valve 162 permits a flow of syrup in the direction from inner end 144 to outlet passageway 150.

The outer end 146 is also connected to check valve 156 by passageway 148, and check valve 156 is connected to passageway 158. The check valve 156 permits a flow of syrup in the direction from passageway 158 to outer end 146. The inner end 144 is connected to check valve 160 by passageway 164, and check valve 160 is connected to passageway 158. The check valve 160 permits a flow of syrup in the direction from passageway 158 to inner end 144.

The passageway 158 connects with the diaphragm chamber 166. Mounted within the diaphragm chamber 166 is a rubber diaphragm 168. The rubber diaphragm 168 is fixedly mounted on a valve spool 170. The peripheral edge of the rubber diaphragm 168 includes an expanding section 172. The expanding section 172 is fixedly mounted on the side wall of the chamber 166. The valve spool 170 includes a piston 174. The piston 174 is movably mounted within a chamber 176. The opposite end of the valve spool 170 is formed into a cup 178. Cup 178 includes an internal open ended compartment 180. The outer surface of the cup 178 is capable of seating against port 182. Within the compartment 180 is located a coil spring 184. The outer end of the coil spring 184 abuts against wall 186 of syrup inlet chamber 188. Syrup inlet channel 42 connects with the syrup inlet chamber 188. The diaphragm chamber 166 has a back side 190 that is continuously connected to ambient air pressure by passageway 192.

Referring now to FIG. 1, when soda, under pressure, is first applied at inlet 40, and assuming slide piston 100 is in the position shown, the soda fluid pressure is communicated through passageway 114 through annular groove 108 into passageway 70 and into chambers 74 and 78. Within chamber 74 valve piston 76 closes port 84. Within chamber 66 the stem 58 of valve piston 60 pushes against valve piston 48 forcing port 66 closed and port 54 open.

Soda pressure is also communicated from passageway 114, through passageway 133, through annular groove 129, into passageways 122 and 124, through outer end of chamber 106 into passageway 72 and into chambers 68 and 78. Within chamber 78, valve piston 80 closes port 92. Within chamber 68, valve piston 64 pushes against valve piston 48. However, force applied by piston 60 is equal to that of piston 48. Therefore, piston 48 remains in its present position. As ports 82 and 92 are closed and solenoid 12 is deenergized, no fluid flows and all conditions remain static.

Referring now to the syrup side of FIG. 1, with syrup present at syrup input channel 42, such communicates with syrup inlet chamber 188 of demand regulator valve 194. Syrup inlet chamber 188 communicates with passageway 196 of valve spool 170 thus maintaining syrup pressure in chamber 176 always equal to syrup input pressure. Cross-sectional area of chamber 176 is equal to cross-sectional area of port 182. Air pressure in back side 190 is held constant by passageway 192 which exhausts into the atmosphere. If syrup drive piston 142 is stationery, chamber 166 is held at or near atmospheric pressure by check valves 154, 156, 160 and 162. Therefore valve spool 170 is pressure balanced and the force of spring 184 closes port 182 and no syrup flows regardless of syrup input pressure. This position is shown in FIG. 1.

Figure 2:
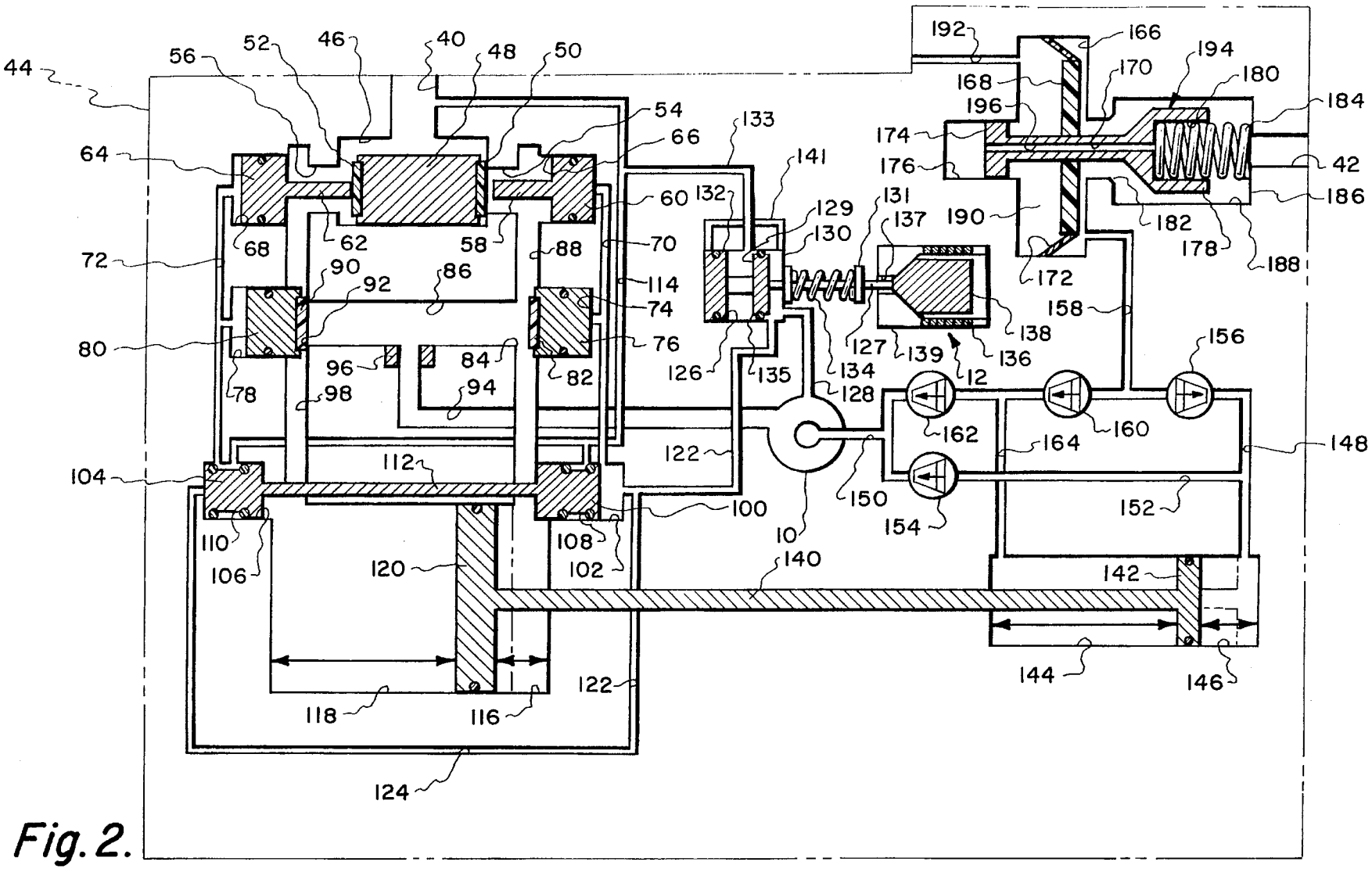
FIG. 2 is a view similar to FIG. 1 but showing the dispensing apparatus in another position.

Activation of solenoid 12 causes electricity to be supplied to the coil 136, which causes block 138 to be drawn toward opening 137, which forces control piston 132 into the open position as shown in FIG. 2. The annular elastomeric seal 129 is positioned within chamber 126 so that soda is prevented from flowing from passageway 133, but allows flow from passageways 124 and 122 into exhaust passageway 128 and nozzle 10. If slide piston 100 is positioned as shown in FIG. 2, passageway 122 communicates downstream pressure with passageways 70 and chambers 66 and 74. Valve piston 76 is forced to the position shown in FIG. 2 opening port 84. Downstream pressure is also supplied to chamber 66. Slide piston 104 causes upstream pressure in passageway 114 to communicate with passageway 72 which forces valve piston 64 to move valve piston 48 opening port 56 and closing port 54. The upstream pressure in passageway 72 also forces valve piston 80 to close port 92 as is shown in FIG. 2.

Soda flows from inlet channel 46 through port 56 into channel 98 bypassing valve pistons 80 since channel 98 is wider than valve piston 80. Soda then flows into outer end 118 of the soda drive piston chamber. The soda drive piston 120 is forced toward the position shown in FIG. 2 forcing the soda in inner end 116 through channel 88, port 84 and flow washer 96 into nozzle 10 and hence into the container (not shown) located under nozzle 10. Soda drive piston 120 drives the syrup drive piston 142 to the position shown in FIG. 2 forcing syrup from the outer end 146 through passageways 148 and 152 and check valve 154 into nozzle 10. Simultaneously as syrup drive piston 142 is forced toward the position shown in FIG. 2, a less than atmospheric pressure is developed in inner end 144, such pressure communicating with passageway 164. Check valve 162 is back-biased and check valve 180 is forward-biased. Check valve 160 communicates the low pressure of inner end 144 to diaphragm chamber 166 by way of passageway 158. The pressure differential at cross diaphragm 168 forces valve spool 170 to open port 182 allowing syrup to flow from syrup inlet chamber 188 into diaphragm chamber 166, through passageway 158 and check valve 160, into inner end 144 of the syrup drive piston chamber. If the input syrup pressure is lower atmospheric, the less than atmospheric pressure, generated by movement of piston 142, in the backside 190 of the diaphragm chamber 166 forces syrup to flow.

If the input syrup pressure is high, pressure within diaphragm chamber 166 increases causing valve spool 170 to move toward back side 190 eventually closing port 182 until syrup flow is equal to that demanded by speed of piston 142. As the soda drive piston 120 enters the right far wall of inner end 116, piston 120 contacts slide piston 100 forcing such toward passageway 122 which causes slide piston 100 to block communication between passageways 70 and 124 and opens communication between passageway 70 and passageway 114. The upstream pressure in chamber 74 forces pistons 76 to the closed position shown in FIG. 1 closing port 84. This same upstream pressure in chamber 66 causes valve piston 60 to move valve piston 48 to open port 54 and close port 56. Simultaneously, slide piston 104 opens communication from passageway 72 to downstream pressure passageway 124 and closes communication from passageway 72 to upstream passageway 114 which forces piston 80 to open port 92 and piston 64 to move to the left far wall of chamber 68. Soda flows from channel 46 through port 66 channel 88 into inner end 116. This flow forces soda drive piston 120 toward outer end 118.

Simultaneously soda drive piston 120 drives syrup drive piston 142 toward inner end 144 which forces the syrup in inner end 144 through passageway 164 and check valve 162 in the nozzle 10. The movement of piston 142 causes a less than atmospheric pressure in outer end 146 which back-biases check valve 154 and forward-biases check valve 156. This low pressure is communicated to diaphragm chamber 166 by passageway 158 which forces diaphragm 168 to move valve spool 170 to open port 182 allowing syrup to flow through diaphragm chamber 166 and check valve 156 into outer end 146 as demanded by the speed of piston 142. The above operation will continue, providing an equal ratio (generally five parts soda to one part syrup) of soda to syrup for each stroke until solenoid 12 is deenergized.

When solenoid 12 deenergizes, passageway 128 is closed and passageway 133 communicates upstream pressure to outer end of chambers 102 and 106. Therefore, regardless of position and pistons 100 and 104, upstream pressure is communicated to outer end of chambers 74 and 78. At that time both pistons 76 and 80 will close ports 84 and 92, respectively and soda flow will stop. Pistons 120 and 142 no longer move and therefore diaphragm chamber 166 of the demand regulator 194 returns to atmospheric pressure and port 182 closes and all syrup flow stops.

What is claimed is:

1. A beverage dispenser apparatus for dispensing through a nozzle a preestablished volume of a syrup and a preestablished volume of a soda to be intermixed within said nozzle, both said syrup and said soda being supplied from separate sources under pressure, said beverage dispensing apparatus comprising:

a syrup side utilizing a first drive piston, said first drive piston moves to cause dispensing of said preestablished volume of syrup into said nozzle, said first drive piston being movable in both a forward and reverse direction within a syrup drive piston chamber, said syrup in said preestablished volume to be dispensed during movement of said first drive piston in said forward direction and also during movement in said reverse direction;

a soda side utilizing a second drive piston, said second drive piston moves to cause dispensing of said preestablished volume of soda into said nozzle, said second drive piston being movable in both said forward and said reverse direction within a soda drive piston chamber, soda in said preestablished volume to be dispensed during movement of said second drive piston in said forward direction and also during movement in said reverse direction, said soda drive piston chamber being spaced from said syrup drive piston chamber; and said soda side including a pair of slide pistons, one of said slide pistons to be physically contactable and movable by said second drive piston during movement in said forward direction, the remaining said slide piston to be physically contactable by said second drive piston during movement in said reverse direction.

2. The beverage dispensing apparatus as defined in claim 1 wherein:

said first drive piston being connected to said second drive piston so both said first drive piston and said second drive piston move together in said forward direction and together in said reverse direction.

3. The beverage dispensing apparatus as defined in claim 1 wherein:

said slide pistons being physically connected together so as to be movable together in said forward direction and in said reverse direction.

4. The beverage dispensing apparatus as defined in claim 1 wherein:

dispensing of both said syrup and said soda to occur simultaneously by activation of a single dispensing solenoid, activation of said dispensing solenoid results in movement of said first and second drive pistons in either said forward direction or said reverse direction.

5. The beverage dispensing apparatus as defined in claim 1 wherein:

said syrup side including a demand regulator, said demand regulator being connected to the source of said syrup, said demand regulator functioning to control the supply of said syrup to said nozzle, said demand regulator places said syrup under ambient atmospheric pressure that is being supplied to said nozzle.

6. The beverage dispensing apparatus as defined in claim 1 wherein:

said pair of slide pistons being connected together to move in unison.

7. A beverage dispenser apparatus for dispensing through a nozzle a preestablished volume of a syrup and a preestablished volume of a soda to be intermixed within said nozzle, both said syrup and said soda being supplied from separate sources under pressure, said beverage dispensing apparatus comprising:

a syrup side utilizing a first drive piston, said first drive piston moves to cause dispensing of said preestablished volume of syrup into said nozzle, said first drive piston being movable in both a forward and reverse direction within a syrup drive piston chamber, said syrup in said preestablished volume to be dispensed during movement of said first drive piston in said forward direction and also during movement in said reverse direction;

a soda side utilizing a second drive piston, said second drive piston moves to cause movement of which causes dispensing of said preestablished volume of soda into said nozzle, said second drive piston being movable in both said forward and said reverse direction within a soda drive piston chamber, soda in said preestablished volume to be dispensed during movement of said second drive piston in said forward direction and also during movement in said reverse direction, said soda drive piston chamber being spaced from said syrup drive piston chamber; and said soda side including a three-way valve, said three-way valve controlling the supply of soda to said nozzle, said three-way valve being contactable by a pair of valve pistons, said valve pistons being in axial alignment relative to said three-way valve with one of said valve pistons being on the opposite side of said three-way valve from the other said valve piston, activation of said valve pistons result in movement of said three-way valve in either said forward or said reverse direction.

8. The beverage dispensing apparatus as defined in claim 7 wherein:

said soda side including two separate outlet valves, each said outlet valve connected to a separate passageway for supplying soda into an outlet passageway, said outlet passageway in said forward direction causes one said outlet valve to be closed and the remaining said outlet valve to be open, movement of said second drive piston in the reverse direction causes the said remaining outlet valve to be open and the first said outlet valve to be closed.

* * * * *